US010694902B2

(12) United States Patent
Felix et al.

(10) Patent No.: US 10,694,902 B2
(45) Date of Patent: Jun. 30, 2020

(54) OUT INDICATOR SHEETS

(71) Applicant: GPCP IP Holdings LLC, Atlanta, GA (US)

(72) Inventors: Jared S. Felix, Fenton, MI (US); William G. Burr, Scandinavia, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 115 days.

(21) Appl. No.: 15/897,213

(22) Filed: Feb. 15, 2018

(65) Prior Publication Data

US 2018/0255982 A1 Sep. 13, 2018

Related U.S. Application Data

(60) Provisional application No. 62/468,442, filed on Mar. 8, 2017.

(51) Int. Cl.

| | |
|---|---|
| ***B65H 29/22*** | (2006.01) |
| ***B65D 83/08*** | (2006.01) |
| ***B41J 15/22*** | (2006.01) |
| ***A47K 10/42*** | (2006.01) |
| ***B31D 1/04*** | (2006.01) |
| ***B41J 3/54*** | (2006.01) |
| ***B41J 2/01*** | (2006.01) |
| ***B65H 45/24*** | (2006.01) |

(52) U.S. Cl.

CPC ..... *A47K 10/421* (2013.01); *B31D 1/04* (2013.01); *B41J 2/01* (2013.01); *B41J 3/543* (2013.01); *B41J 15/22* (2013.01); *B65H 29/22* (2013.01); *B65H 45/24* (2013.01); *A47K 2010/428* (2013.01); *B65D 83/0805* (2013.01); *B65D 2203/04* (2013.01)

(58) Field of Classification Search

None

See application file for complete search history.

(56) References Cited

U.S. PATENT DOCUMENTS

| | | | | |
|---|---|---|---|---|
| 4,195,787 | A * | 4/1980 | Thomason | A47K 10/16 206/390 |
| 4,901,663 | A * | 2/1990 | De Luca | A47K 10/16 116/200 |
| 4,925,214 | A * | 5/1990 | Hazelton | B42D 19/00 242/912 |
| 5,368,188 | A * | 11/1994 | Twardowski | A47K 10/42 206/494 |
| 5,531,325 | A | 7/1996 | Deflander et al. | |
| 5,802,974 | A | 9/1998 | McNeil | |
| 5,839,688 | A | 11/1998 | Hertel et al. | |
| 6,257,410 | B1 | 7/2001 | Ulmann et al. | |

(Continued)

*Primary Examiner* — Gene O Crawford
*Assistant Examiner* — Ayodeji T Ojofeitimi
(74) *Attorney, Agent, or Firm* — Laura L. Bozek

(57) ABSTRACT

Embodiments are directed to a dispensing device and methods of using a dispensing device having an improved out indicator. The dispensing device includes a housing having a cavity. A tissue stack is disposed within the cavity, the tissue stack including a plurality of tissue sheets folded along a crease. An aperture is formed in a top surface of the housing such that a tissue sheet is removable from the cavity through the aperture. A portion of the tissue sheets includes an out indicator formed along a centerline of each tissue sheet and across the crease.

10 Claims, 5 Drawing Sheets

(56) References Cited

U.S. PATENT DOCUMENTS

| | | | | |
|---|---|---|---|---|
| 6,273,313 | B1 | 8/2001 | Noll et al. | |
| 6,282,807 | B1 * | 9/2001 | Johnson | B65D 83/0841 116/200 |
| 6,607,110 | B2 * | 8/2003 | Nusbaum | B65D 83/0882 225/18 |
| 6,898,881 | B2 * | 5/2005 | Morrison | G09F 3/10 116/200 |
| 6,926,308 | B2 | 8/2005 | Penn et al. | |
| 6,929,838 | B1 | 8/2005 | McNeil | |
| 6,983,686 | B2 | 1/2006 | Vaughn et al. | |
| 7,077,073 | B2 | 7/2006 | Judge et al. | |
| 7,384,505 | B2 | 6/2008 | Zoller et al. | |
| 7,793,608 | B1 * | 9/2010 | Udouj | B65H 18/28 116/200 |
| 7,799,168 | B2 | 9/2010 | Zoller et al. | |
| 8,016,978 | B2 | 9/2011 | Sauter et al. | |
| 8,038,446 | B2 | 10/2011 | Cohen et al. | |
| 8,205,748 | B2 | 6/2012 | Long et al. | |
| 8,844,437 | B2 | 9/2014 | Baggot et al. | |
| 2004/0255810 | A1 | 12/2004 | O'Brien et al. | |
| 2007/0006985 | A1 | 1/2007 | Lee et al. | |
| 2007/0044928 | A1 | 3/2007 | Shannon et al. | |
| 2007/0084099 | A1 | 4/2007 | Sarbo et al. | |
| 2008/0022872 | A1 | 1/2008 | Nanisetty et al. | |
| 2009/0127149 | A1 | 5/2009 | Samarcq et al. | |
| 2010/0009826 | A1 | 1/2010 | Basin et al. | |
| 2010/0276428 | A1 * | 11/2010 | Lord | B65F 1/062 220/495.07 |

* cited by examiner

OUT INDICATOR SHEETS

CROSS-REFERENCE TO RELATED APPLICATION

This application claims the benefit of U.S. Provisional Application No. 62/468,442 filed Mar. 8, 2017, and entitled "Out Indicator Sheets" the content of which is hereby incorporated by reference in its entirety.

BACKGROUND

The present invention relates in general to tissue and paper fabrication methods and resulting devices. More specifically, the present invention relates to fabrication methods and resulting structures for a dispensed folded tissue having an image printed across the center of the tissue fold indicating the amount of tissue remaining in a dispenser.

Tissue and paper sheets for household use are well known in the art. It is often desired to decorate such sheets, such as by printing or embossing an image onto the sheets. The image imparts an aesthetically pleasing pattern to the sheet. Such sheets are typically made in continuous form and then later cut to discrete lengths as desired. Such cutting to discrete lengths may occur at the point of use, such as is caused by the consumer detaching one sheet from the balance thereof at a line of termination. For this purpose, the line of termination typically comprises a line of weakness, such as a perforation. Alternatively, the continuous sheet can be cut into discrete portions prior to the point of use. Such arrangement often occurs in individual napkins or facial tissues that are cut during manufacture and purchased by the consumer as discrete units. Where tissue is packaged within a dispenser and is used by pulling sheets of tissue out of the dispenser a visual indicator that the dispenser has reached different stages of advancement towards the end of the product is useful.

SUMMARY

According to an embodiment of the present invention, a dispensing device having an improved out indicator is provided. The device can include a housing having a cavity. A tissue stack is disposed within the cavity, the tissue stack including a plurality of tissue sheets folded along a crease. An aperture is formed in a top surface of the housing such that a tissue sheet is removable from the cavity through the aperture. A portion of the tissue sheets includes an out indicator formed along a centerline of each tissue sheet and across the crease.

According to another embodiment, a method for forming a tissue is provided. The method includes receiving a first sheet from a first parent roll. The first sheet is transported via a first roller beneath a surface of a first print head. The first print head is positioned above the first sheet and directly over the first roller. The method includes spraying, from the first print head, wax ink onto a surface of the first sheet to form a first out indicator on the surface of the first sheet. A second sheet is received from a second parent roll and transported via a second roller beneath a surface of a second print head. The second print head is positioned above the second sheet and directly over the second roller. The method includes spraying, from the second print head, wax ink onto a surface of the second sheet to form a second out indicator on the surface of the second sheet. The first sheet and the second sheet are interfolded to form a tissue stack.

According to another embodiment, an apparatus for forming a tissue having an out indicator is provided. The apparatus includes a first parent roll comprising a first tissue sheet and a second parent roll comprising a second tissue sheet. The apparatus further includes a first printing apparatus comprising eight print heads and a second printing apparatus comprising eight print heads. The apparatus further includes a first plurality of rollers for transporting the first tissue sheet beneath a surface of each print head of the first printing apparatus. Each print head is positioned above a surface of the first tissue sheet and directly over a roller of the first plurality of rollers. The apparatus further includes a second plurality of rollers for transporting the second tissue sheet beneath a surface of each print head of the second printing apparatus. Each print head is positioned above a surface of the second tissue sheet and directly over a roller of the second plurality of rollers. The apparatus further includes an interfolding apparatus for interfolding the first sheet and the second sheet to form a tissue stack.

BRIEF DESCRIPTION OF THE DRAWINGS

The subject matter of the present invention is particularly pointed out and distinctly defined in the claims at the conclusion of the specification. The foregoing and other features and advantages are apparent from the following detailed description taken in conjunction with the accompanying drawings in which:

DETAILED DESCRIPTION

Figure 1:
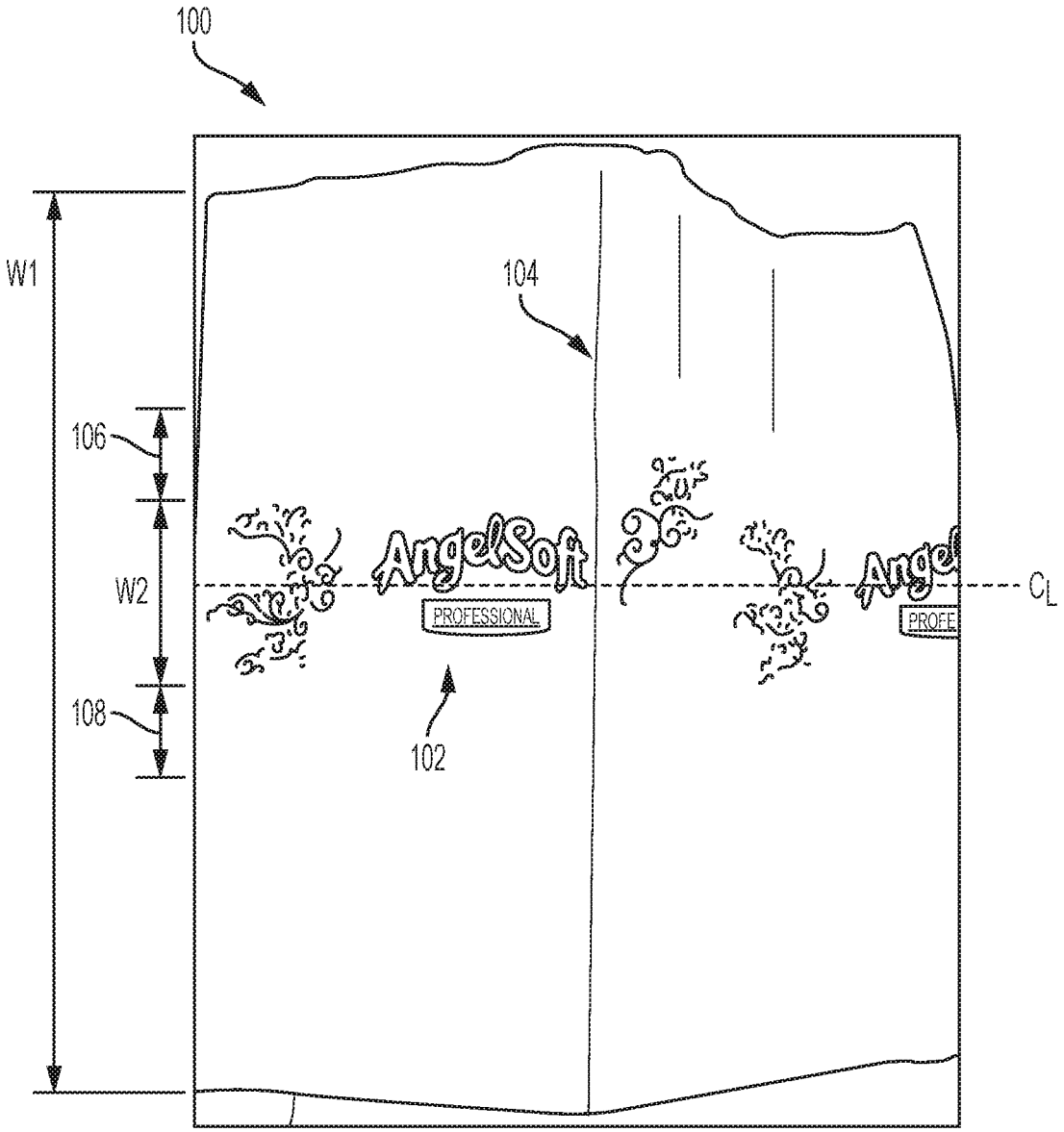
FIG. 1 depicts a top-down view of a folded tissue stack having an improved out indicator according to one or more embodiments of the present invention.

Various embodiments of the present invention are described herein with reference to the related drawings. Alternative embodiments can be devised without departing from the scope of this invention. It is noted that various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. As an example of an indirect positional relationship, references in the present description to forming layer "A" over layer "B" include situations in which one or more intermediate layers (e.g., layer "C") is between layer "A" and layer "B" as long as the relevant characteristics and functionalities of layer "A" and layer "B" are not substantially changed by the intermediate layer(s).

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection."

References in the specification to "one embodiment," "an embodiment," "an example embodiment," etc., indicate that the embodiment described can include a particular feature, structure, or characteristic, but every embodiment may or may not include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of the description hereinafter, the terms "upper," "lower," "right," "left," "vertical," "horizontal," "top," "bottom," and derivatives thereof shall relate to the disclosed structures and methods, as oriented in the drawing figures. The terms "overlying," "atop," "on top," "positioned on" or "positioned atop" mean that a first element, such as a first structure, is present on a second element, such as a second structure, wherein intervening elements such as an interface structure can be present between the first element and the second element. The term "direct contact" means that a first element, such as a first structure, and a second element, such as a second structure, is connected without any intermediary elements at the interface of the two elements.

As used herein, a "unit" is defined as that portion of the sheet that is discrete as delivered to the consumer. For example, this would include, but not be limited to, a single table napkin, a single roll of paper toweling, a single facial tissue, or a single roll of bath tissue.

As used herein, the terms "about," "substantially," "approximately," and variations thereof are intended to include the degree of error associated with measurement of the particular quantity based upon the equipment available at the time of filing the application. For example, "about" can include a range of ±8% or 5%, or 2% of a given value.

As used herein, "continuous" means a relatively long product produced in a mostly continuous manufacturing process. An example of a continuous product for use in the present process or apparatus is a rolled sheet where the length of the sheet on the roll is very long in relation to its width.

For the sake of brevity, conventional techniques related to tissue paper fabrication may or may not be described in detail herein. Moreover, the various tasks and process steps described herein can be incorporated into a more comprehensive procedure or process having additional steps or functionality not described in detail herein. In particular, various steps employed in the manufacture of tissue paper are well known and so, in the interest of brevity, many conventional steps will only be mentioned briefly herein or will be omitted entirely without providing the well-known process details.

As previously noted herein, household tissue and paper sheets are often decorated with printed or embossed images. In many cases, these images conventionally serve as product logos or advertisements meant to be seen by the consumer during use. One disadvantage of using printed or embossed images on a tissue sheet as logos or pure advertisements is that the images provide no additional information to the consumer. In some cases, images can be used to indicate that the unit (e.g., a box of tissue within a dispenser) will soon need to be replaced. In this manner, the image serves as an "out indicator" and the sheet having the image serves as an "out indicator sheet." Out indicator sheets are typically patterned with a stripe of ink across the width of the sheet. In some cases, the entire out indicator sheet is colored to distinguish the out indicator sheet from other sheets.

There are disadvantages associated with the conventional use of out indicator sheets. Tissue sheets are deformed when placed into a dispenser. Consequently, the size and placement of the out indicator often results in the image being difficult to see from multiple vantage points once the product is placed within the dispenser. Moreover, conventional out indicator stripes or fully colored out indicator sheets inform consumers that replacement of the unit is required, but do not provide the consumer with any additional information, such as, for example, how many sheets remain within the dispenser. Thus, an improved out indicator sheet is desired.

One or more embodiments of the present disclosure relate to fabrication methods and resulting structures for a dispensable folded tissue having improved out indicator sheets. Each out indicator sheet includes an image printed or embossed across the center of a tissue fold. Placing the image across the center of the tissue fold greatly improves the visibility of the image once the out indicator sheet is pulled out of the dispenser. The image serves as a visual indication of the relative or actual amount of tissue remaining in a dispenser. The image can simultaneously serve as both an advertising logo and as an out indicator. A tissue product and associated manufacturing methods in accordance with embodiments of the present invention are described in detail below by referring to the accompanying drawings in FIGS. 1-5.

Figure 2:
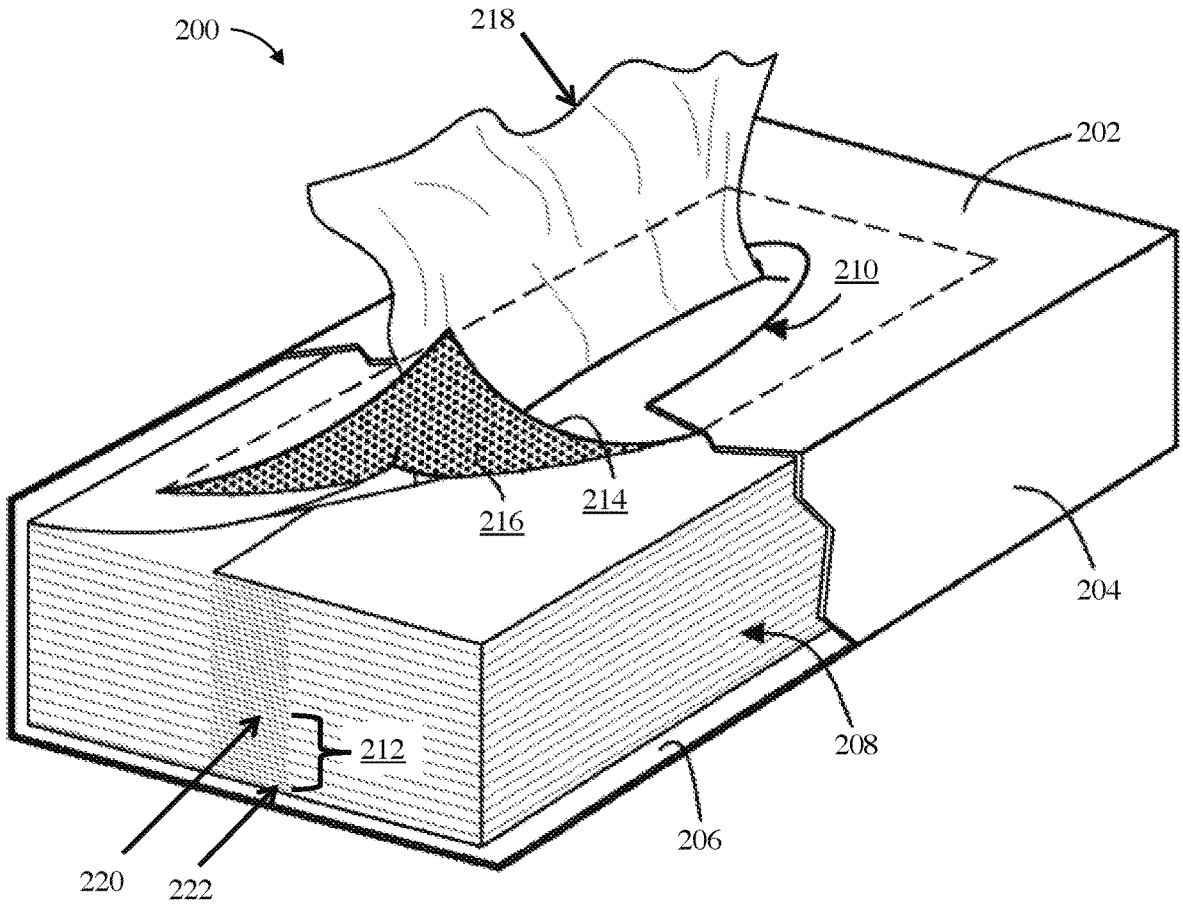
FIG. 2 depicts a view of a dispenser for housing the folded tissue stack of FIG. 1 according to one or more embodiments of the present invention.

FIG. 1 illustrates a top-down view of a folded tissue stack 100 having an improved out indicator 102 according to one or more embodiments of the present invention. The folded tissue stack 100 includes a plurality of tissue sheets folded along a crease 104. A portion of the tissue sheets are out indicator sheets (as depicted in FIG. 2). Each out indicator sheet in the folded tissue stack 100 includes a sheet width W1 and an out indicator width W2. The sheets can be of any dimensions known in the art. In some embodiments, the sheet width W1 is about 7 inches to about 9 inches. In some embodiments, the sheet width W1 is about 7.8 inches. It is understood that the sheets can be of other dimensions suitable for tissue or paper. In some embodiments, the out indicator width W2 is about 1.5 to about 3.5 inches. In some embodiments, the out indicator width W2 is about 2 inches. In some embodiments, the out indicator width W2 is sized proportionally to the sheet width W1. In some embodiments, the out indicator width W2 is sized such that about 20%, about 25%, or about 30% of the sheet surface is covered by the out indicator 102.

The out indicator 102 is formed along a centerline $C_L$ of each out indicator sheet across the crease 104. In some embodiments, the out indicator 102 is not perfectly centered about the centerline $C_L$ and is instead formed within a top tolerance 106 or bottom tolerance 108 of the centerline $C_L$. The top and bottom tolerances 106 and 108 depict a maximum acceptable drift from the centerline $C_L$ of the out indicator 102. If the out indicator 102 is printed on a sheet above the top tolerance 106 or below the bottom tolerance 108 the sheet is discarded. In some embodiments, the top tolerance 106 and the bottom tolerance 108 is about 0.5 inches. It is understood that the top and bottom tolerances 106 and 108 can be increased or decreased to relax or tighten, respectfully, the process for forming the out indicator 102 (e.g., printing or embossing). In some embodiments, the out indicator 102 includes a logo. In this manner, the out indicator 102 serves a dual purpose as both an advertisement and as a visual indicator.

FIG. 2 illustrates a view of a dispenser 200 according to one or more embodiments of the present invention. The dispenser 200 includes a top surface 202, a sidewall 204, a bottom (not depicted), and a cavity 206. In some embodiments, the dispenser 200 is rectangular in shape (e.g., as depicted in FIG. 2). In other embodiments, the dispenser is square shaped or circular shaped. It is understood that the shape of the dispenser 200 can be any suitable shape known for dispensing tissue. A folded tissue stack 208 is disposed within the cavity 206. In some embodiments, the folded tissue stack 208 is the folded tissue stack 100 (as depicted in FIG. 1). The folded tissue stack 208 includes a plurality of stacked tissue sheets (i.e., tissues). Each tissue is folded along a crease (e.g., the crease 104 of FIG. 1). An aperture 210 is formed in the top surface 202 of the dispenser 200. The aperture 210 allows for one or more tissues 218 to be removed from the cavity 206. In some embodiments, a dispensing insert 214 having a bottom liner 216 is disposed within the cavity 206 on top of the folded tissue stack 208 such that the aperture 210 is at least partially covered. In this manner, the dispensing insert 214 limits the extent of the container which is open to contamination, yet allows one or more tissues 218 to be dispensed. In some embodiments, the dispensing insert 214 is designed to remain in place within the dispenser 200 until all tissues of the folded tissue stack 208 have been dispensed.

In some embodiments, a portion 212 of the tissue sheets in the folded tissue stack 208 includes an out indicator (e.g., the out indicator 102 of FIG. 1) while the remaining tissue sheets in the folded tissue stack 208 do not include an out indicator. The tissue sheets in the portion 212 (i.e., those tissues having an out indicator) are known as out indicator sheets. In some embodiments, the portion 212 includes about 5% to about 10% of the total number of tissues in the folded tissue stack 208. In some embodiments, the portion 212 includes less than about 35%, 25%, 20%, 15%, 10%, or 5% of the total number of tissues in the folded tissue stack 208. In some embodiments, the portion 212 includes 1 to 15 tissues. In some embodiments, the portion 212 includes 6 to 8 tissues. In some embodiments, the portion 212 includes every tissue in the folded tissue stack 208. In some embodiments, the portion 212 includes a first indicator sheet 220 and a last indicator sheet 222. The last indicator sheet 222 is the bottom sheet of the folded tissue stack 208.

As discussed previously herein, the out indicator 102 is formed along a centerline $C_L$ of each out indicator sheet across the crease 104 (as depicted in FIG. 1). Locating the out indicator 102 in this way allows for at least a portion of the out indicator 102 to be viewable from multiple angles after pulling an out indicator sheet from the dispenser 200. In some embodiments, the out indicator 102 visually indicates that the dispenser 200 has reached different stages of advancement towards the end of the folded tissue stack 208. In this manner, a consumer can look at the out indicator 102 and determine whether the folded tissue stack 208 will soon need to be replaced. In some embodiments, each tissue of the folded tissue stack 208 includes a first color and the out indicator 102 includes a second color. In some embodiments, the first color and second color are complementary colors.

In some embodiments, the out indicator 102 progressively changes in a characteristic between adjacent out indicator sheets. In some embodiments, the characteristic is a color intensity, color saturation, hue, physical size, positioning, or transparency of the out indicator 102. In some embodiments, the change in the characteristic between adjacent out indicator sheets is about 1% to about 75%. In some embodiments, the change is linear. For example, a change in the characteristic between a pair of adjacent out indicator sheets is the same for all pairs of adjacent out indicator sheets). In some embodiments, the linear change in the characteristic between adjacent out indicator sheets is about 5% or about 2%. For example, a change in color intensity between the first indicator sheet 220 and a second indicator sheet can be about 2% and consequently, a change in color intensity between the second indicator sheet and a third indicator sheet is also 2%.

In some embodiments, the change in characteristic is exponential. In some embodiments, the rate of change accelerates or decelerates between the first indicator sheet 220 and the last indicator sheet 222. For example, the change in color intensity between the first indicator sheet 220 and a second indicator sheet can be about 2% and a change in color intensity between a penultimate indicator sheet and the last indicator sheet 222 can be greater than about 2%, such as 5%, 10%, 20%, or 40%. In this manner, the out indicator 102 provides consumers with an initial visual indicator that the folded tissue stack 208 will need to be replaced in the near future that quickly escalates as the last sheets of the folded tissue stack 208 are used and replacement becomes imminent.

In some embodiments, the change in characteristic decreases from a high value on the first indicator sheet 220 to a relatively lower value on the last indicator sheet 222. For example, the transparency of the out indicator 102 can be highest on the first indicator sheet 220 and lowest on the last indicator sheet 222. In this manner, the out indicator 102 is barely visible on the first indicator sheet 220, but is easily noticed on the last indicator sheet 222. In some embodiments, the change in characteristic increases from a low value on the first indicator sheet 220 to a relatively higher value on the last indicator sheet 222. For example, the color intensity of the out indicator 102 can be lowest on the first indicator sheet 220 and highest on the last indicator sheet 222. In this manner, the out indicator 102 is less noticeable on the first indicator sheet 220 than on the last indicator sheet 222. In some embodiments, the change in characteristic is stepwise such that the characteristic is the same between some pairs of adjacent out indicator sheets. For example, the color intensity of the out indicator 102 can increase between the first indicator sheet 220 and the last indicator sheet 222 while remaining the same between one or more pairs of adjacent out indicator sheets (e.g., the color intensity is the same for the first indicator sheet 220 and a second indicator sheet and the color intensity increases between the second indicator sheet and a third indicator sheet).

Figure 3:
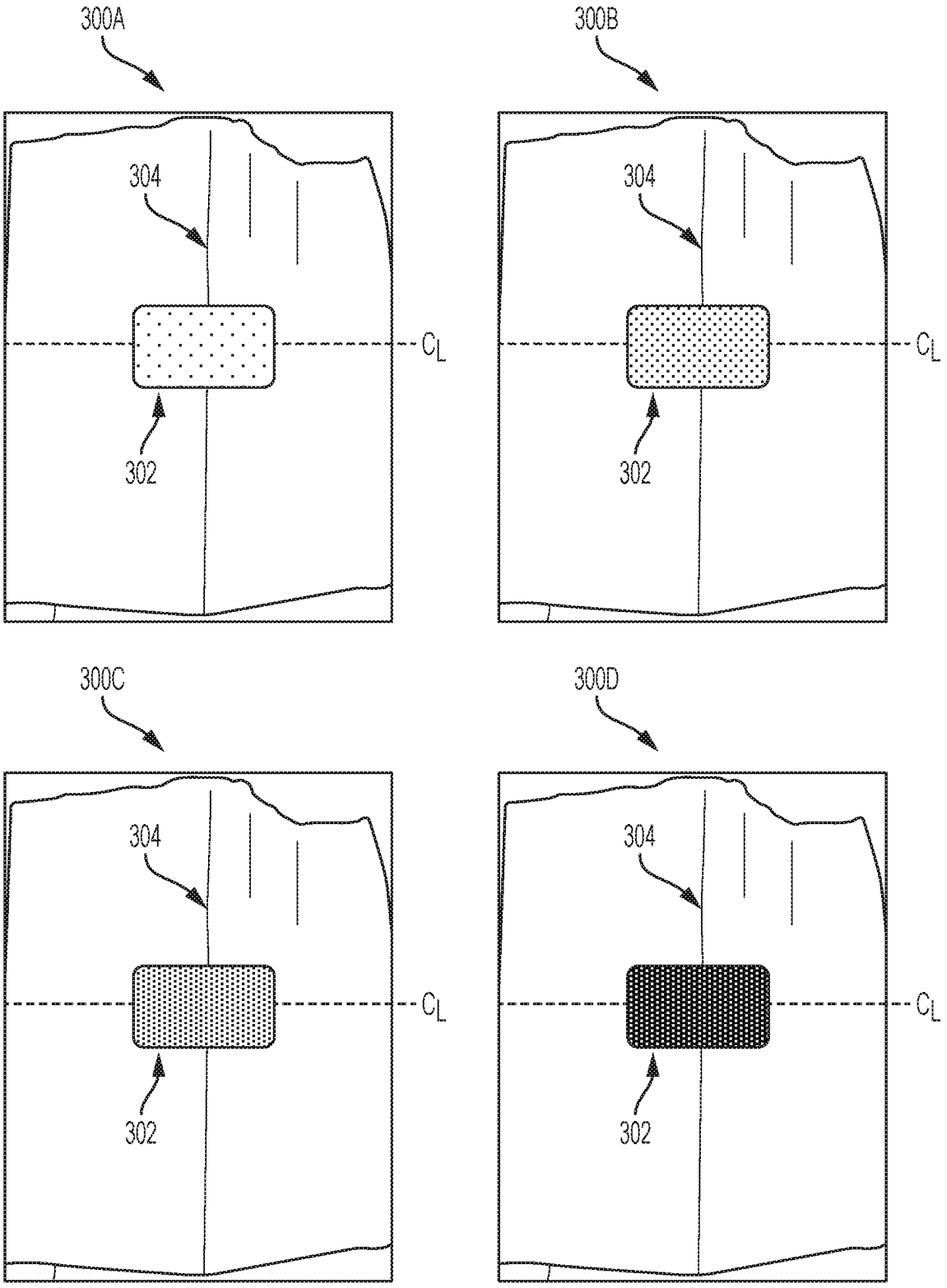
FIG. 3 depicts a top-down view of out indicator sheets having an improved out indicator formed across a crease and centered on a centerline of each sheet according to one or more embodiments of the present invention.

FIG. 3 illustrates a top-down view of out indicator sheets 300A, 300B, 300C, and 300D having an improved out indicator 302 formed across a crease 304 and centered on a centerline $C_L$ according to one or more embodiments of the present invention. The out indicator sheets 300A, 300B, 300C, and 300D depict different topmost out indicator sheets of the same folded tissue stack (i.e., the folded tissue stack 208 depicted in FIG. 2) as the tissues are used over time. The change in characteristic (i.e., the pattern of the out indicator 302) progressively increases from a relatively low value on the out indicator sheet 300A to a relatively high value on the out indicator sheet 300D according to one or more embodiments.

Figure 4:
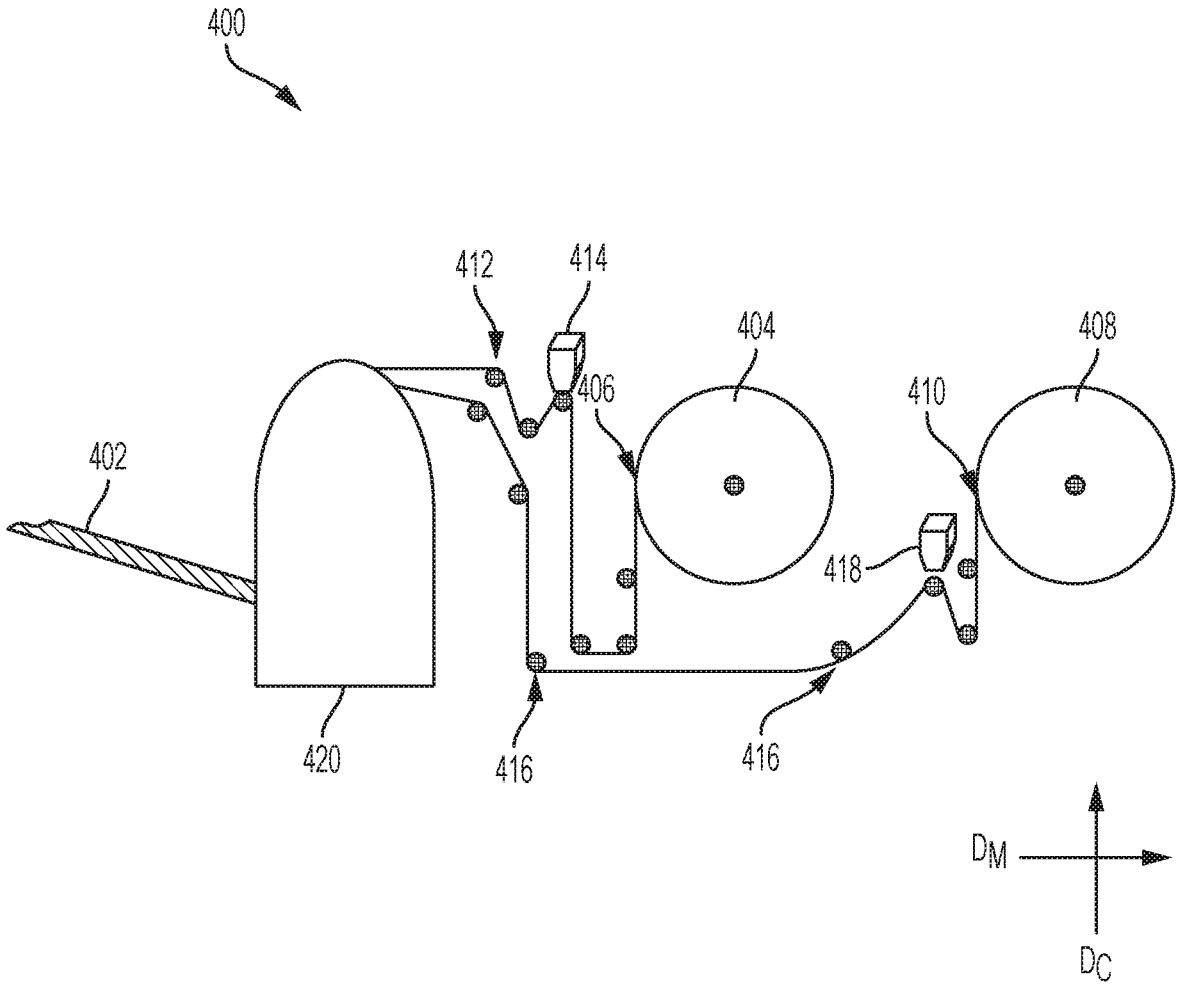
FIG. 4 depicts a cross-sectional view of an apparatus during an intermediate operation for forming an out indicator on a tissue sheet according to one or more embodiments of the present invention.

FIG. 4 illustrates a cross-sectional view of an apparatus 400 during an intermediate operation for forming a tissue stack 402 (also referred to as a tissue "log" or interfolded tissue) having an out indicator according to one or more embodiments. In some embodiments, the apparatus 400 includes a first parent roll 404 having a first tissue sheet 406 and a second parent roll 408 having a second tissue sheet 410. The first tissue sheet 406 moves through the apparatus 400 in a machine direction $D_M$ by way of a first plurality of rollers 412. The actual number of rollers is not meant to be particularly limited and it is understood that the apparatus 400 can include any number of rollers known in the art. In some embodiments, the first tissue sheet 406 includes one or more tissue sheet "wads" (i.e., the first tissue sheet 406 can be portioned along a cross direction $D_C$ perpendicular to the machine direction $D_M$ into one or more parallel lines or "wads").

The first tissue sheet 406 is transported via the first plurality of rollers 412 beneath a surface of a print module 414. In a similar manner, the second tissue sheet 410 is transported via a second plurality of rollers 416 beneath a surface of a print module 418. In some embodiments, each of the print modules 414 and 418 includes dual print modules, each controlling four print heads (i.e., the apparatus 400 includes eight print heads per parent roll). In some embodiments, each print head sprays wax ink onto a surface of the first or second tissue sheets 406 and 410, respectively, to form an out indicator on the surface of each sheet according to one or more embodiments.

In some embodiments, the print heads are located about 0.125 inches to about 0.200 inches above the first and second tissue sheets 406 and 410 and directly over a roller of the first or second plurality of rollers 412 and 416, respectively. In some embodiments, each print head is mounted over the first and second tissue sheets 406 and 410 in a specified location relative to the center of a tissue wad. In some embodiments, the print heads can be moved from left to right in the cross direction $D_C$ to center the out indicator relative to each respective tissue wad. In some embodiments, print delay settings within apparatus 400 can be increased or decreased to adjust when or for how long printing will begin and end for a particular portion of first and second tissue sheets 406 and 410.

Mounting the print heads directly over a roller at a distance of about 0.125 inches to about 0.200 inches above the first and second tissue sheets 406 and 410 provides several advantages over mounting the print heads just off or above the roller (i.e., at positions less than about 0.125 inches or more than about 0.200 inches above or below the first and second tissue sheets 406 and 410). Positioning the print heads less than about 0.125 inches above a roller causes a static induction on each print head which results in charged dust accumulating on each print head. The charged dust interferes with the print application, causing dust contamination and an increase in plugged print heads. Conversely, locating the print heads within about 0.125 to 0.200 inches of a roller neutralizes the static charge in the narrow contact zone (i.e., a portion of the surface of the first or second tissue sheets 406 and 410 directly under a print head). Positioning the print heads more than about 0.200 inches above a roller causes a loss in print quality. In some cases, portions of the out indicator can contain streaks rendering the out indicator unreadable. In other cases, portions of the out indicator can be entirely missing. In some embodiments, the print heads are periodically purged to further increase the print quality.

Once out indicators are printed onto surfaces of the first and second tissue sheets 406 and 410, the first and second tissue sheets 406 and 410 are transported to an interfolding apparatus 420. The interfolding apparatus 420 interfolds the first and second tissue sheets 406 and 410 into the single tissue stack 402.

Figure 5:
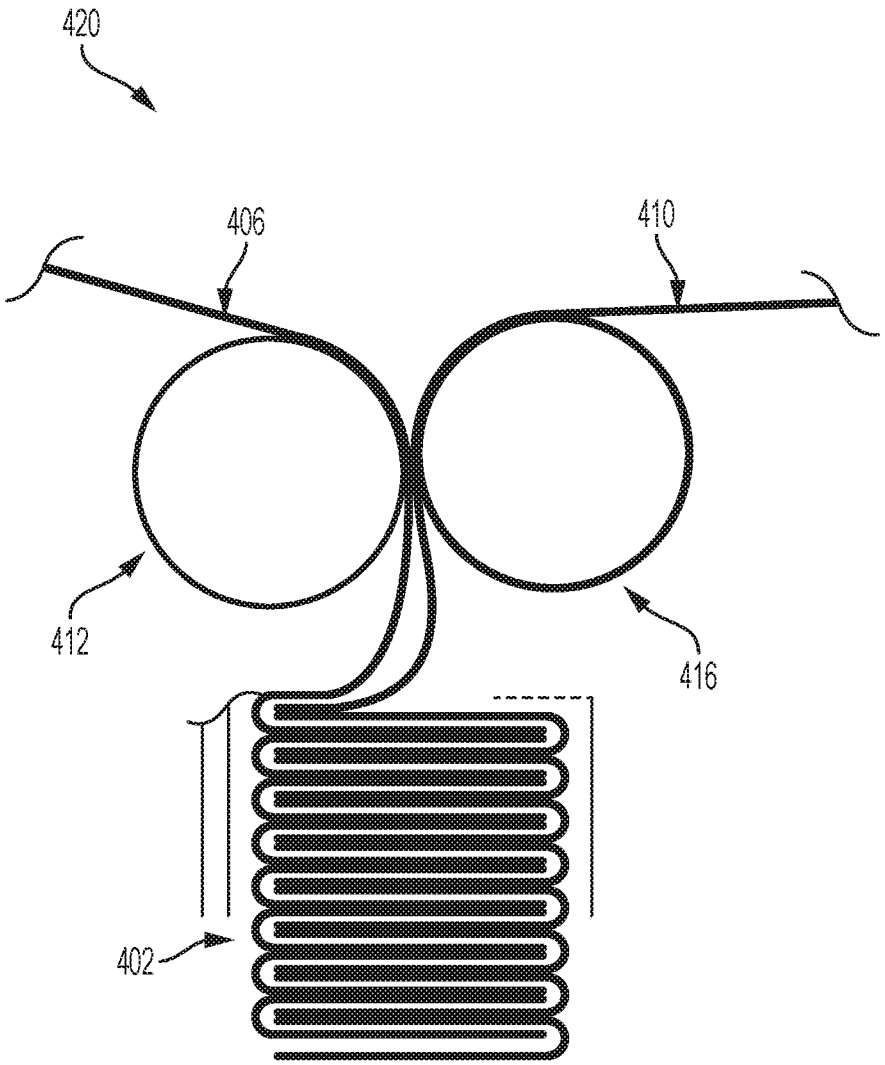
FIG. 5 depicts a cross-sectional view of an interfolding apparatus during an intermediate operation for forming a tissue stack according to one or more embodiments of the present invention.

FIG. 5 illustrates a cross-sectional view of an interfolding apparatus 420 during an intermediate operation for forming a tissue stack 402 according to one or more embodiments. From this view it is apparent that the interfolding apparatus 420 receives the first tissue sheet 406 from a roller of the first plurality of rollers 412 and the second tissue sheet 410 from a roller of the second plurality of rollers 416. In some embodiments, opposite surfaces of the first and second tissue sheets 406 and 410 are interfolded into a single tissue stack 402. In some embodiments, the tissue stack 402 is cut to a specified length. The tissue stack 402 can be cut using, for example, a saw or other known apparatus for cutting tissue stacks.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

What is claimed is:

1. A dispensing device comprising:

a housing having a cavity;

a tissue stack disposed within the cavity, the tissue stack comprising a plurality of tissue sheets folded along a crease; and an aperture formed in a top surface of the housing such that a tissue sheet is removable from the cavity through the aperture;

wherein a portion of the tissue sheets comprise an out indicator formed along a centerline of each tissue sheet and across the crease, wherein the portion of the tissue sheets comprising an out indicator further comprises a first indicator sheet and a last indicator sheet, the last indicator sheet is a bottom sheet of the tissue stack, and wherein the out indicator progressively changes in a characteristic between the first indicator sheet and the last indicator sheet.

2. The dispensing device of claim 1, wherein the out indicator covers about 25% of a surface of each tissue sheet.

3. The dispensing device of claim 1, wherein the portion of the tissue sheets comprising an out indicator comprises about 5% to about 10% of the tissue sheets.

4. The dispensing device of claim 1, wherein the out indicator is formed within a first and second tolerance of the centerline of each tissue sheet.

5. The dispensing device of claim 1, wherein the out indicator comprises a logo.

6. The dispensing device of claim 1, wherein each tissue sheet of the tissue stack comprises a first color and the out indicator comprises a second color.

7. The dispensing device of claim 1, wherein the characteristic is a color intensity, hue, saturation, size, position, or transparency of the out indicator.

8. The dispensing device of claim 7, wherein the characteristic decreases from a high value on the first indicator sheet to a low value on the last indicator sheet.

9. The dispensing device of claim 7, wherein the characteristic increases from a low value on the first indicator sheet to a high value on the last indicator sheet.

10. The dispensing device of claim 9, wherein the increase in the value of the characteristic between adjacent tissue sheets is about 1% to about 3%.

* * * * *